United States Patent [19]

Husson et al.

[11] Patent Number: 4,650,037

[45] Date of Patent: Mar. 17, 1987

[54] ELEVATOR SYSTEM

[75] Inventors: Alan L. Husson, Long Valley; Kim E. Morris, Chester Township, Morris County, both of N.J.

[73] Assignee: Westinghouse Electric Corp., Pittsburgh, Pa.

[21] Appl. No.: 741,402

[22] Filed: Jun. 5, 1985

[51] Int. Cl.[4] ..... B66B 3/00

[52] U.S. Cl. ..... 187/130; 187/121; 187/135

[58] Field of Search ..... 187/29 R; 340/19 R

[56] References Cited

U.S. PATENT DOCUMENTS

| | | | |
|---|---|---|---|
| 3,706,972 | 12/1972 | Okuhara | 340/82 |
| 3,706,983 | 12/1972 | Olson et al. | 340/251 |
| 4,173,750 | 11/1979 | Riba | 340/80 |
| 4,217,576 | 8/1980 | Wreford-Howard | 340/642 |
| 4,234,878 | 11/1980 | Stark | 340/642 |
| 4,295,079 | 10/1981 | Otsuka et al. | 315/130 |
| 4,307,392 | 12/1981 | Loshbough et al. | 340/715 |
| 4,323,841 | 4/1982 | Jacobsen | 324/51 |
| 4,354,181 | 10/1982 | Spletzer | 340/642 |
| 4,555,689 | 11/1985 | Brick et al. | 187/29 R X |

*Primary Examiner*—William M. Shoop, Jr.
*Assistant Examiner*—Richard K. Blum
*Attorney, Agent, or Firm*—D. R. Lackey

[57] ABSTRACT

Methods and apparatus for selectively controlling the energization of a plurality of lamps in an elevator system, utilizing a microcomputer based lamp controller, and for detecting failure of the lamps while utilizing a minimum number of communication lines. A first communication line synchronizes signals which are placed on the remaining communication lines. Signals indicating the need for lamp energization are detected by the lamp controller. When such signals are recognized by the lamp controller, the lamp controller prepares and places signals on a second communication line which requests lamp energization of the associated lamps, and it stores indications of the requests. Signals responsive to the detection of actual energization of a lamp are placed on a third communication line and directed to the lamp controller. The lamp controller logically relates signals detected on the third communication line with the stored indications of lamp energization requests to determine or test system integrity, and to detect lamp burn-out.

16 Claims, 16 Drawing Figures

ELEVATOR SYSTEM

BACKGROUND OF THE INVENTION

1. Field of the Invention

The invention relates to the control of a plurality of lamps in an elevator system, and to the detection of burned-out lamps while utilizing a single microcomputer based lamp controller and a minimum number of communication lines between the controller and lamp drivers.

2. Description of the Prior Art

The power and control wiring required for the various lamps at the floors of a building associated with an elevator system, such as the hall call lamps associated with the hall call pushbuttons, and the hall lanterns, is costly to install and maintain. Thus, it is desirable to minimize the number of power and communication lines required for any one function.

One of the most troublesome problems in the maintenance and servicing of an elevator system is the detection of burned-out lamps, or other similar indicators. The detection of such failures is labor intensive, especially for lamps which are located at the various floors. Sericve personnel are required to check the associated up and down hall lanterns at each fllor, as well as the up and down hall call registered lamps associated with the up and down hall call pushbuttons at each floor. Thus, it would be desirable to be able to check the integrity of lamp control circuitry and to detect burned-out lamps automatically, providing stored records which pinpoint problems and failed lamps for maintenance personnel, without requiring a microcomputer based controller at each floor of the building.

It would further be desirable to add the capability of testing sytem integrity and detecting failed lamps, without increasing the number of signal lines in the floor-to-floor communication bus, and without occupying additional communication time slots on any existing serialized signal communication line. Occupying communication time slots by the testing and checking function would reduce the number of lamps that may be served by one bus. Finally, the system checking function must be accomplished a very little additional cost per lamp, due to the large number of lamps associated with the hall call and hall lantern functions.

SUMMARY OF THE INVENTION

Briefly, the present invention relates to an elevator system, and methods of controlling the lamps of an elevator system, in which a plurality of floor related hall call and hall latern lamps are controlled, as required by elevator traffic and service conditions, and automatically and continuously tested, all by a single microcomputer based lamp controller, as each elevator car of the elevator system goes about its normal everyday activities. The testing function has been added without increasing the number of conductors in the bus which runs from the controller to the lamp drivers, and without occupying separate or additional time slots in the serial communication signals. Further, no microcomputers are required for per-floor lamp control.

Detection of a lamp failure, as well as an indication of the specific lamp involved, is automatically stored in a memory. The contents of the memory may be periodically transferred to a remote maintenance office, or it may be periodically read by on-site maintenance personnel, as desired. The new and improved lamp control methods also permit the testing of the integrity of a lamp control system in a test mode, which does not require the operation of the elevator cars.

More specifically, the basic lamp control for the hall call and hall lantern functions requires only one microcomputer based lamp controller, and a communication bus requiring only three communication lines which extend between the lamp controller and lamp drivers. A first line provides timing signals for synchronizing data signals applied to the second and third lines. Signals which indicate a pushbutton associated lamp should be energized, are placed on the second communication line and directed to the controller. Signals which indicate a hall lantern should be energized are placed in, and retrieved from, a hall lantern enable memory. When the controller recognizes a hall call signal on the second communication line, or detects a set hall lantern enable bit in the associated enable memory, the controller prepares signals which request lamp energization, and these signals are placed on the third communication line.

The ability to test system integrity, and to detect lamp burn-out via a single microcomputer based controller is achieved without adding any additional signal communication lines, and without occupying any additional communication time slots, by utilizing the normal lamp control communication lines, and by utilizing the same communication time slots used for lamp control. The only additional hardware required is a low-cost opto-coupler for each lamp. The opto-coupler provides a signal when its associated lamp is energized. The generation of this signal by the opto-coupler results in a signal being placed on the second communication line.

Logic in the microcomputer based lamp controller stores an indication that it has recognized a signal or set bit indicating the need for lamp energization, and that it has prepared and sent a signal to a specific lamp driver which requests lamp energization. These stored indications of processed lamps are continuously compared by the microcomputer with signals detected on the second communication line. A signal on the second communication line for which there is no associated stored indication, indicates a new hall call signal, which is to be recognized and responded to. A stored indication which has no associated signal on the second communication line indicates a problem, most likely lamp burn-out, and this situation causes a record to be stored for maintenance purposes, identifying the lamp in question.

System integrity may be checked without operating the elevator cars by simply entering lamp turn-on requests on the third communication line, and comparing these requests with signals subsequently received on the second communication line. If "matching" signals are found, i.e., a signal on the second line for each request placed on the third line, the system is operating properly. A lamp turn-on request placed on the third line for which no corresponding synchronized signal is detected on the second line, indicates a problem with a lamp, and/or the communication system, depending upon whether the problem is universal or confined to a specific lamp and its associated driver circuit.

BRIEF DESCRIPTION OF THE DRAWINGS

The invention may be better understood and further advantages and uses thereof more readily apparent, when considered in view of the following detailed description of exemplary embodiments, taken with the accompanying drawings, in which.

DESCRIPTION OF PREFERRED EMBODIMENTS

Figure 1A:
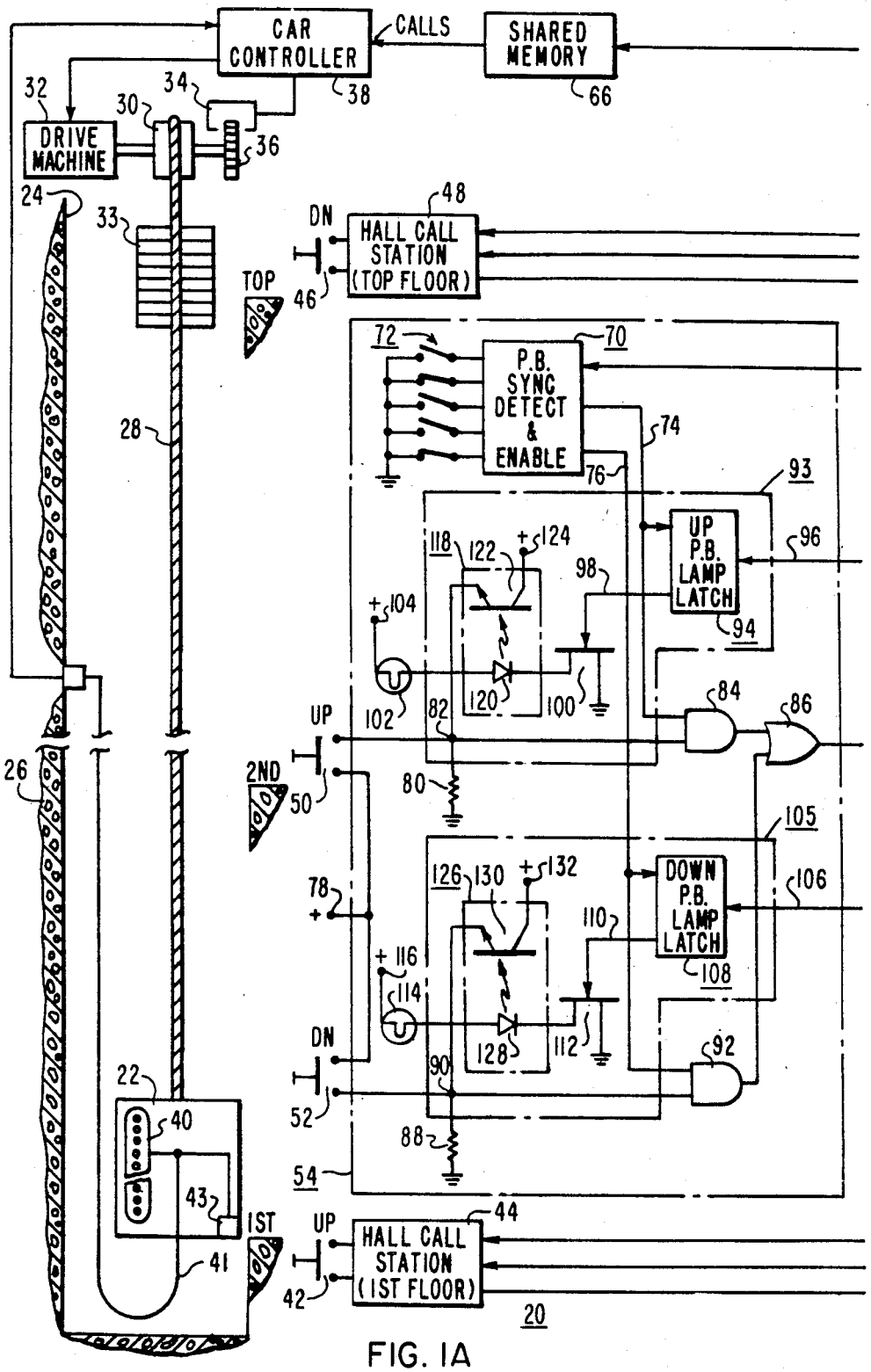
FIGS. 1A and 1B may be combined to provide a schematic diagram of an elevator system having burned-out lamp detector means for the hall call and hall lantern functions constructed according to the teachings of the invention.
Figure 1B:
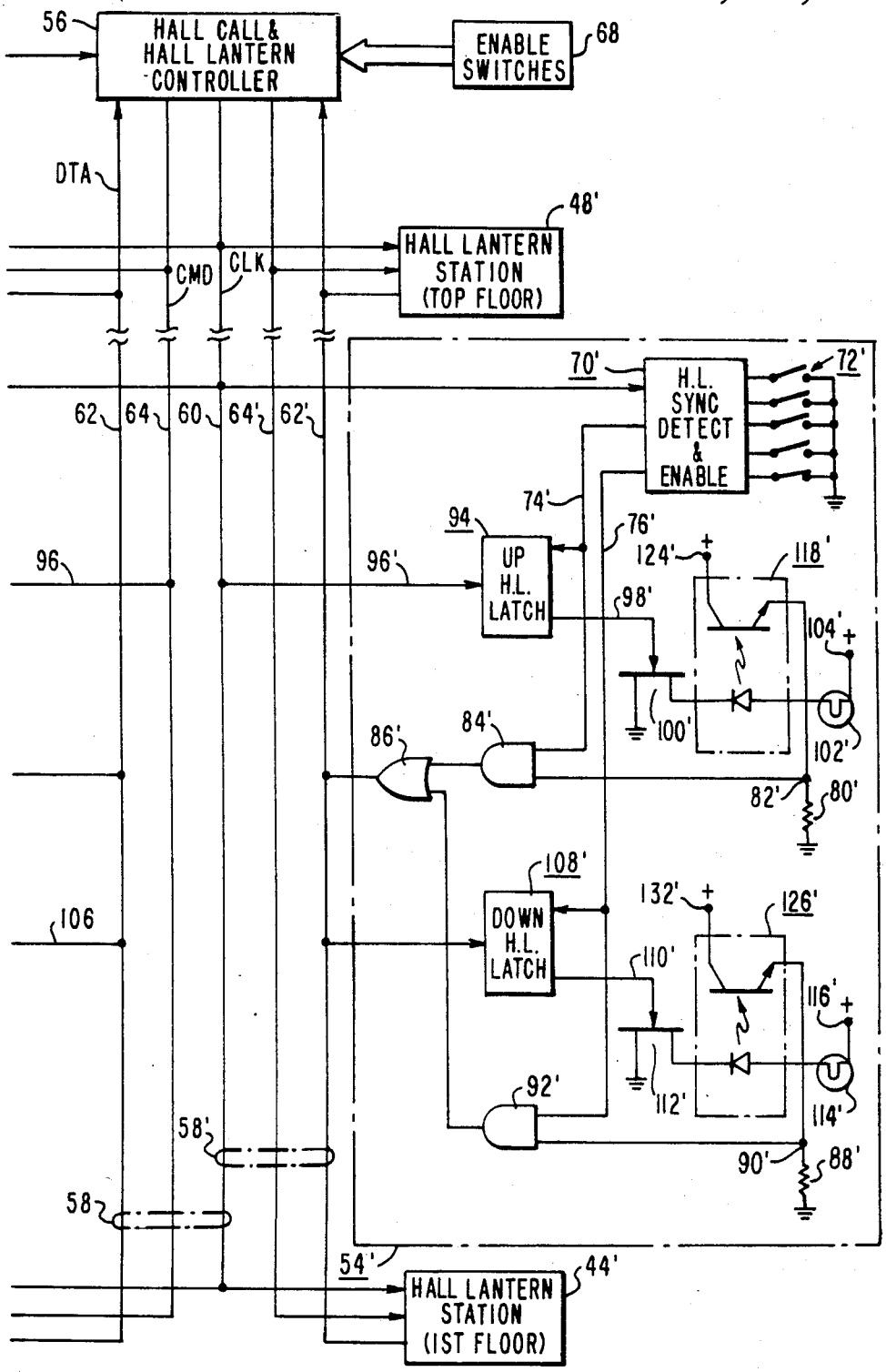

Referring now to the drawings, and to FIGS. 1A and 1B in particular, there is shown an elevator system 20 constructed to utilize the teachings of the invention in hall call and hall lantern functions. U.S. Pat. Nos. 3,750,850 and 3,804,209 may be referred to to obtain details of an operative elevator system, which details are not shown in FIG. 1. These patents are hereby incorporated into the present application by reference. Only that part of elevator system 20 which is necessary in order to understand the present invention will be described in detail.

Elevator system 20 includes one or more elevator cars, such as car 22. When a plurality of cars are in system 20, they may be controlled by a group supervisory controller or system processor (not shown) which includes the strategy for operating the cars to serve hall calls efficiently. Since each of the elevator cars of a bank of cars, and the controls therefore, would be similar in construction and operation, only the controls for car 22 are illustrated in FIG. 1A. More specifically, elevator car 22 is mounted in a hoistway 24 for movement relative to a structure 26 having a plurality of floors or landings, with only the first, second and top floors being shown in order to simplify the drawing. Elevator car 22 is supported by a plurality of wire ropes 28, which are reeved over a traction drive sheave 30 mounted on a shaft of a traction drive machine 32 having an AC or DC drive motor. A counterweight 33 is connected to the other ends of the ropes 28. A pickup 34 detects movement of the car 22 through the effect of circumferentially spaced openings in a pulse wheel 36 driven with the drive sheave 30, or with a governor sheave (not shown). The openings in the pulse wheel are spaced to provide a pulse for each standard increment of travel of car 22, such as a pulse for each 0.25 inch of car travel. Pickup 34 provides pulses for a car controller 38 which includes a floor selector and a speed pattern generator.

Car calls, as registered by pushbutton array 40 mounted in the car 22 are directed to the car controller 38 via a traveling cable 41. Signals from landing control 43 are also directed to the car controller via the traveling cable 41.

Hall calls are registered by pushbuttons and associated hall call stations mounted in the hallways, such as the up hall call pushbutton 42 and associated hall call station 44 located at the bottom floor, the down hall call pushbutton 46 and associated hall call station 48 located at the top floor, and the up and down hall call pushbuttons 50 and 52, respectively, and associated hall call station 54, located at the second and other intermediate floors.

The car controller 38 keeps track of the car location, and the calls for service for the elevator car, it provides a request-to-accelerate signal ACC to the speed pattern generator to initiate a run, and it provides a deceleration signal DEC for the speed pattern generator at the precise time required to decelerate the car according to a predetermined deceleration speed pattern and stop at a target floor for which a call for service has been registered. While the teachings of the invention apply equally to other elevator functions having a plurality of lamps or equivalent indicators which must be selectively energized, for purposes of example the hall call lamp and hall lantern communication system has been chosen for exemplary implementation.

Since each of the hall call and hall lantern stations are of similar construction, only hall and hall call lantern stations 54 and 54', respectively, for the second floor are shown in detail in FIG. 1. Each hall call station performs its functions without the necessity of an associated microcomputer, with a computer function being located in a single supervisory lamp controller.

More specifically, the hall call stations, such as hall station 54, and the hall call lantern stations, such as station 54', are connected to a supervisory lamp controller 56 via a communication bus 58. The hall call function alone, without the hall lantern function, requires a bus 58 having only first, second and third communication lines 60, 62 and 64, respectively. The teachings of the invention may be applied to the hall call function without increasing the number of communication lines in bus 58. The hall lantern function may be added to the hall call function without increasing the number of lines in bus 58, by multiplexing the hall call and hall lantern signals. In a preferred emodiment, however, certain aspects of the invention are simplified by dividing the hall call and hall lantern functions into separate communication links. For example, the teachings of the invention may be extended to the hall lantern function by adding a bus 58' having three communication lines 60, 62' and 64'. Line 60, which is a clock line, is common to both busses 58 and 58'.

The functions of controller 56 may be performed by one or more microcomputers, as desired, with a microcomputer including the usual central processing unit (CPU), random-access memory (RAM), read-only-memory (ROM), and input and output communication ports. Controller 56 places timing signals on the first communication line 60, which function as synchronizing signals for successively enabling the various pushbuttons and lamps of the hall stations. Thus, hall calls placed on the second communication line 62 from a hall call station are properly synchronized into the associated time slot which identifies the hall call station, and lamp turn-on requests placed on the third communication line 64 when controller 56 recognizes a new hall call, or a hall lantern enable, are also properly synchronized into the correct time slot. Controller 56, in addition to recognizing hall calls and hall lantern enables, and requesting that the associated lamp be energized to indicate recognition, also maintains a hall call table which will be referred to as a button status table BST, a floor enable table FET, and hall lantern data and enable tables HLD and HLE respectively. For ease in transferring new hall calls to the car controller, or to a group supervisory controller, tables BST, FET, HLD and HLE are maintained in a random-access memory 66 which is shared by the car controller 38, or a group supervisory controller, as the case may be. For example, the car controller 38 consults memory 66 and compares a prior image of the BST with the latest status of the BST to detect the setting of new hall calls. When a hall call is being served, lamp controller 56 resets the associated floor enable bit in FET, which results in the hall call being reset, and it enables the associated hall lantern bit in HLE, which results in the energization of the correct hall lantern, such as will be hereinafter described relative to FIG, 2.

In many elevator systems, floors may be enabled and/or removed from elevator service, as desired, from a traffic director's station or other central location, merely by setting and resetting floor related enable switches 68. Controller 56 takes into account floors which have been disabled by the enable switches 68, before it prepares a lamp turn-on request for a pushbutton associated lamp, as part of a serial signal CMD applied to the third communication line 64, and before it sets a corresponding bit in the BST of memory 66.

Except for the addition of pushbuttons, the hall lantern station 54' may be the same as the hall call station 54'. Like elements in the two stations are given like reference numerals, with the addition of a prime mark in hall lantern station 54'. Thus, only hall call station 54 will be described in detail. More specifically, hall call station 54 includes synchronization detection and enable means 70, such as a comparator. Means 70 monitors serial addresses CLK which are on the first communication line 60, by comparing these signals with its own unique binary address set by switches 72, such as thumb switches. When means 70 detects its own unique address, it enables output line 74 by driving it high for the first half of the time slot, and then it enables output line 76 by driving it high for the remaining half cycle of the time slot.

When up pushbutton 50 is actuated, a voltage source 78 appears across a resistor 80 at a terminal 82. The cycle time for processing all of the enabling time slots is short enough that button 50 will be actuated while the up enable line 74 goes high. Thus, the output of an AND gate 84 goes high for the duration of the enable signal, and an OR gate 86 applies a logic one signal to data line 62. Data line 62 provides a serial signal DTA to controller 56. Controller 56 recognizes a logic one in the first half of the time slot as an up direction related signal from the second floor.

In like manner, when the down hall call pushbutton 52 is actuated, a source voltage 78 appears across a resistor 88 at a terminal 90, and an AND gate 92 applies a logic one signal to the input of the OR gate 86, which in turn applies a synchronized logic one signal to communication data line 62. Controller 56 recognizes a logic one signal in the second half of the time slot as a down direction related signal from the second floor.

When controller 56 recognizes a new hall call, and the hall call originates from an enabled floor, as determined by the position of its associated enable switch in the group of switches 68, it sets an appropriate bit in the button status table BST located in shared memory 66. Controller 56 also outputs a synchronized bit on the third communication line 64 as part of a serial signal CMD. If the hall call originated from the up pushbutton 50, when the up service enable line 74 goes high lamp driver means 93 is enabled. For example, the high signal on line 74 may enable an up lamp latch 94, such as a flip-flop, and while latch 94 is enabled a synchronized logic one signal in the serial signal CMD will be applied to the input line 96 of latch 94. This high input signal is latched and applied to output line 98. The high output on line 98 turns on a solid state switch 100, such as a field effect transistor, energizing up hall call indicator lamp 102 from a suitable voltage source 104. As long as this up hall call is active, a high synchronized signal will be applied to the input of latch 94, maintaining the energization of lamp 102. When this hall call is served, controller 56 resets the appropriate enable bit in shared memory 66, and the logic one signal is removed from the appropriate time slot of CMD. Thus, the output of latch 94 will then go low when latch 94 is enabled, and the low signal will be clocked to its output line 98, turning switch 100 off and deenergizing lamp 102.

In like manner, when pushbutton 52 initiates a new down hall call, and floor #2 is enabled by the appropriate switch in the group of enable switches 68, controller 56 sets an appropriate bit in the BST, and it sets a synchronized bit in the serial signal CMD on line 64 associated with the lamp driver means 105. Lamp driver means 105 includes a latch 108, with input line 106 of latch 108 going to a logic one while its enable input is held high by enable line 76. The high input on line 106 is transferred to an output line 110 which turns on a solid state switch 112 to energize a down hall call indicator lamp 114 from a voltage source 116.

In accordance with the teachings of the invention, actual energization or illumination of each hall call lamp is detected, and when a hall call lamp is energized a signal corresponding to continuous actuation of the associated pushbutton is simulated. Actual energization of a lamp, for example, may be detected by a low cost opto-coupler IC package containing a light emitting diode (LED) and a phototransistor. Actual energization of lamp 102 may be detected by an opto-coupler 118 which includes a LED 120 and a phototransistor 122. LED 120 is connected to be energized when lamp 102 is energized. When LED 120 is energized it turns on phototransistor 122 which connects a source voltage 124 to terminal 82. This simulates continuous actuation of pushbutton 50, for as long as lamp 102 is energized. Controller 56 does not recognize the resulting synchronized signal appearing on line 62 as being a new up hall call, however, as the hall call controller has already recognized an active, i.e., non-reset up hall call from this pushbutton. The presence of this signal on line 62 provided by opto-coupler 118 as part of serial signal DTA is used by logic contained in a lamp controller program, as will be hereinafter described, to test system integrity and detect burn-out lamps.

In like manner, energization of lamp 114 associated with the down wall call pushbutton 52 may be detected by an opto-coupler 126 having an LED 128 and a phototransistor 130, and a voltage source 132.

Figure 2A:
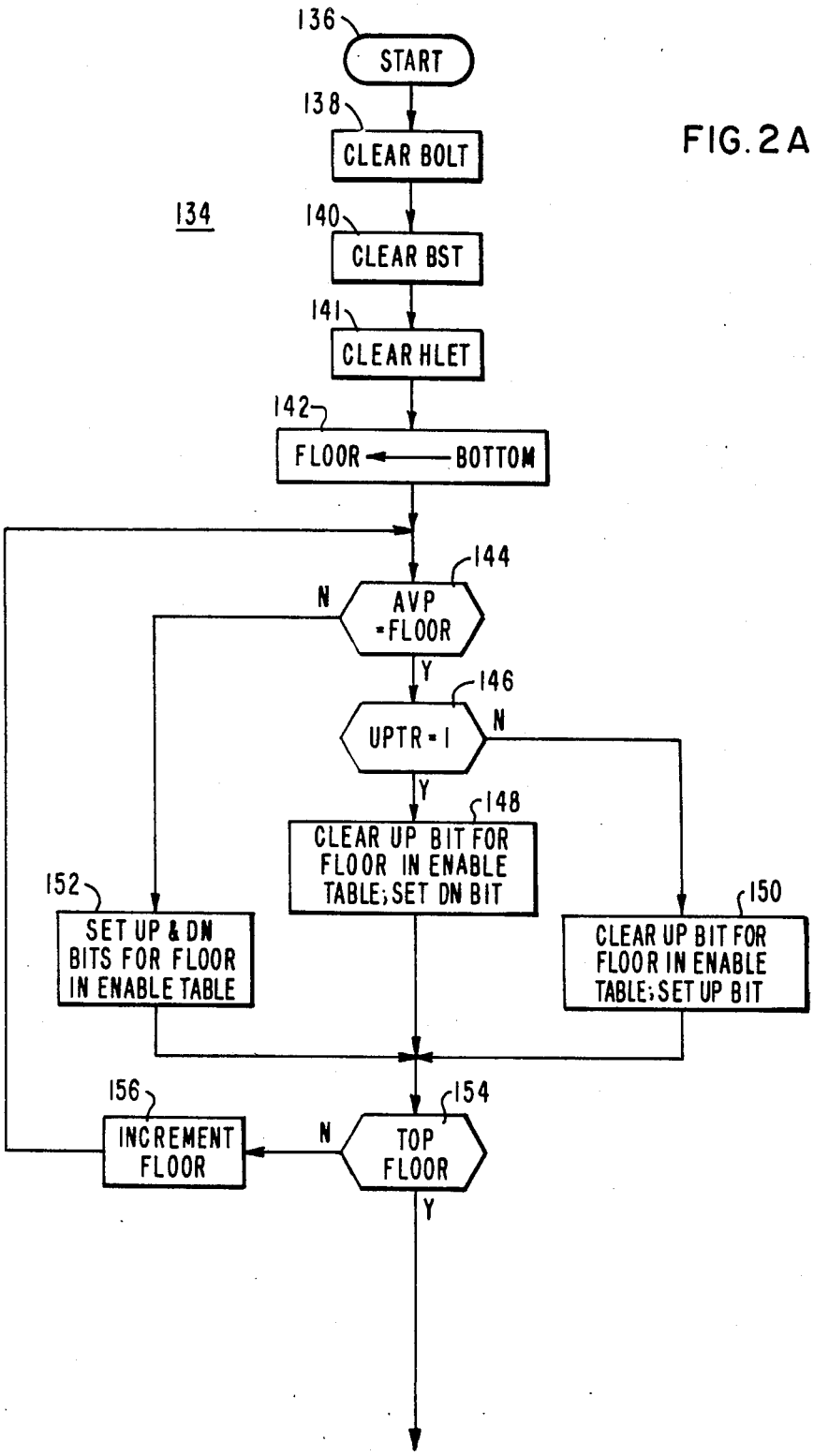
FIGS. 2A and 2B are a flow chart of a program which may be used to tabulate and update hall call and hall lantern enables for the various floors of the building, in which the elevator system is installed.
Figure 2B:
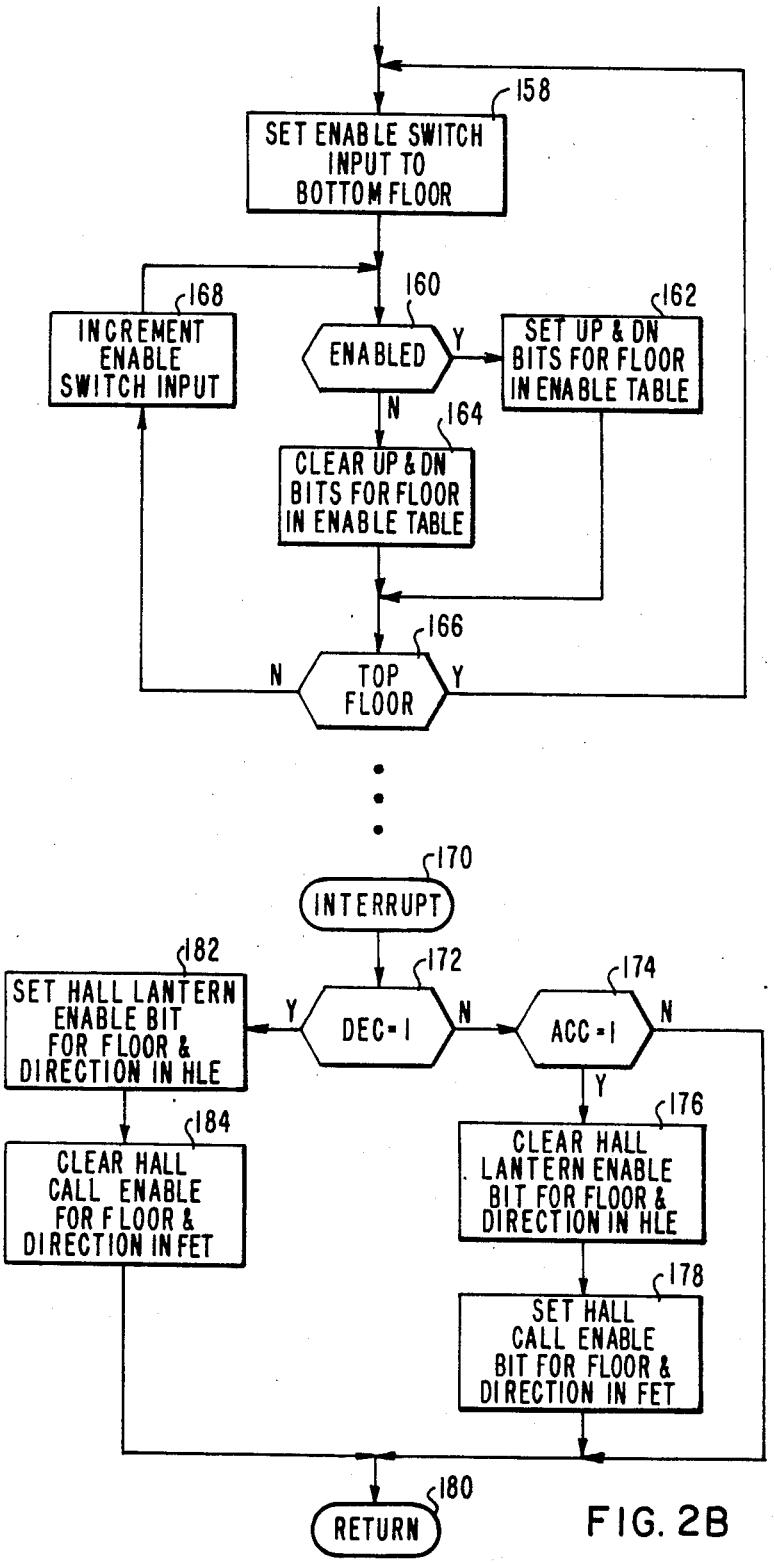
Figure 3:
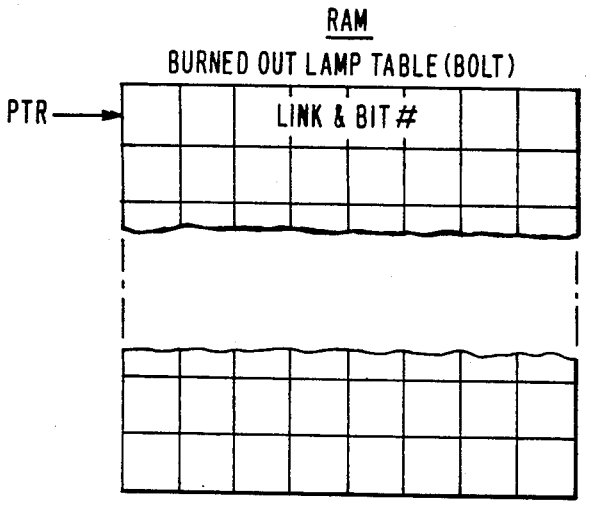
FIG. 3 is a RAM map of a burned-out lamp table BOLT referred to in the program of FIG. 2.

FIG. 2 is a flow chart of a program 134 which may be run by controller 56 to detect new inputs from enable switches 68, and to update the floor and lantern enable tables FET and HLE, respectively, which continuously set forth the current enable status of all of the floors of building 26. A separate dedicated microcomputer in controller 56 may update the enables according to program 134 of FIG. 2. Program 134 is entered at input 136. Step 138 clears a burned-out lamp table BOLT stored in RAM of controller 56, and it initializes a pointer DPTR to the start of the table. FIG. 3 is a RAM map setting forth a suitable format for BOLT.

In an exemplary embodiment of the invention, all data links are read simultaneously, synchronized by a clock cycle having 64 pulses or scan slots O–63. Thus, each pulse results in the reading and storing of a plurality of bits, with each bit being associated with a specific floor number and service direction, depending upon which link it is located in. The exact location of a burned-out lamp may thus be indicated by storing the link number and bit number in BOLT. BOLT is maintained for the use of maintenance personnel. Its contents may be displayed and/or printed out upon command, locally and/or remotely, as desired.

Figure 4:
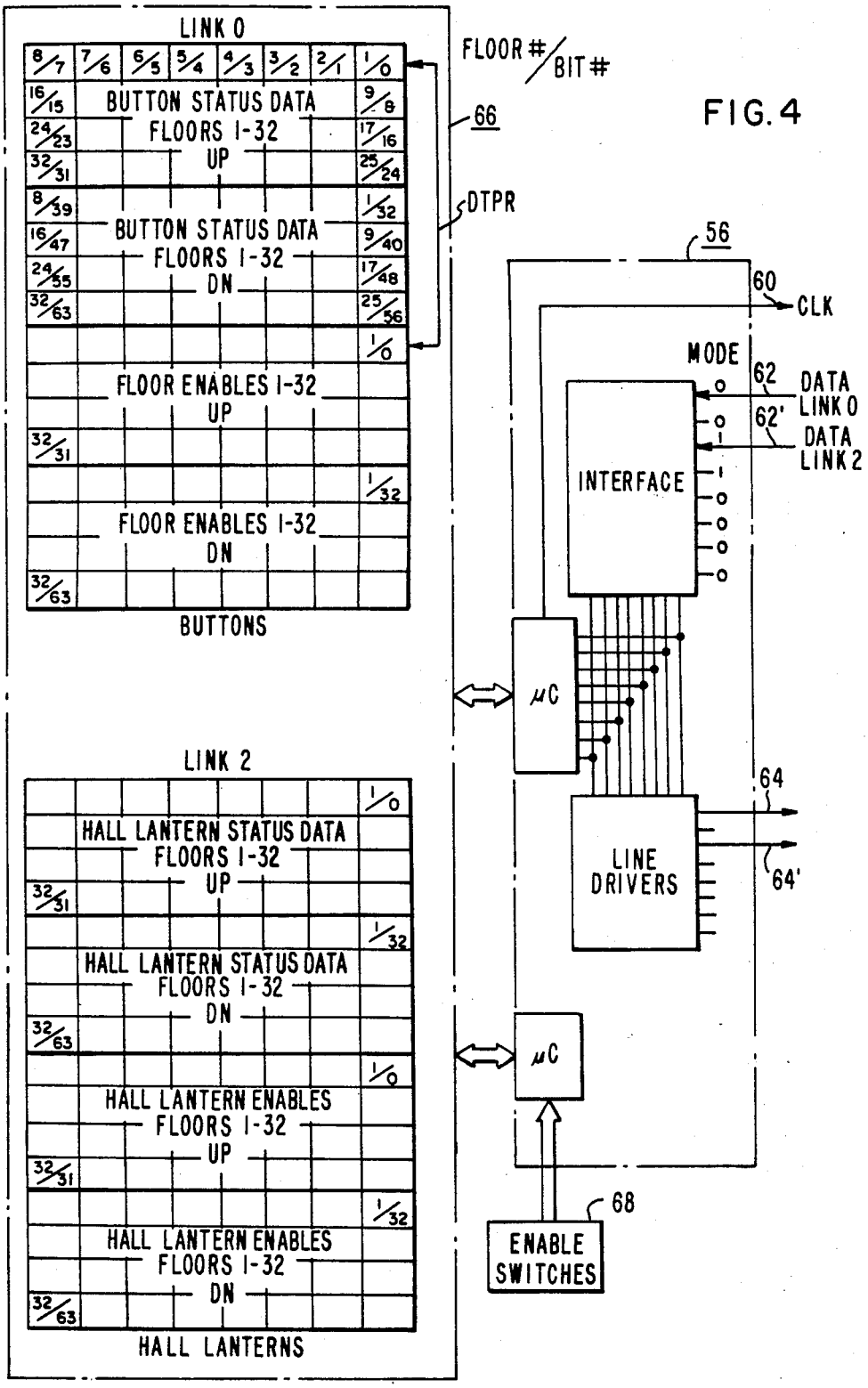
FIG. 4 is a RAM map of button status tables and the enables for the hall call pushbuttons and hall lanterns referred to in the program of FIG. 2 and a block diagram of lamp controller 56.

Step 140 clears the button status table BST, which functions as an active up and down hall call table. FIG. 4 includes a RAM map of shared memory 66 setting forth a suitable format which may be used for BST, as well as FET, HLD, and HLE. The format utilizes eight links each storing sixteen bytes of information. Each link stores either hall call data or hall lantern data. A status or mode bit shown in FIG. 4 adjacent to the data link input to controller 56 indicates the type of data in each link. A logic zero mode bit indicates that the associated link stores hall call information, (up and down hall calls and floor enables) and a logic one indicates that the associated link stores hall lantern information (hall lantern data and hall call enables). Links 0 and 1 in the example are hall call related, with link 0 being associated with floors 1–32 and link 1 being associated with floors 33–64. Links 2 and 3 are hall lantern related, associated with floors 1–32 and 33–64, respectively. For purposes of example, it will be assumed that building 26 has 32 floors, or less. Thus, only data links 0 and 2 are utilized.

Step 141 clears the hall lantern enable table HLE shown in FIG. 4.

Steps 142 through 156 initialize the floor enable table FET shown in FIG. 4 according to car position. The hall call pushbutton associated with the advanced car position and car travel direction is disabled, to reset a call which may have been registered therefrom, and all other pushbuttons are enabled. The advanced car position of a stationary car is its actual floor location, and the advanced car position of a moving car is the floor ahead at which it can make a normal stop according to a predetermined deceleration schedule.

More specifically, step 142 starts the floor enable table initialization by setting a variable FLOOR to the binary address of the bottom floor. Step 144 compares the binary address AVP of the advanced car position with FLOOR to determine if they are equal. If they are, step 146 checks the cars present or last travel direction by examining signal UPTR. If it is a logic one, the car is set for up travel, and step 148 clears, i.e., disables, the up bit for FLOOR in the floor enable table FET, and it sets, i.e., enables, the down bit for FLOOR (unless FLOOR is the bottom floor). If step 146 finds UPTR is not a logic one, step 150 clears the down bit and set the up bit for FLOOR in the floor enable table FET. If step 144 finds AVP and FLOOR do not match, step 152 sets the up and down bits for FLOOR in enable table FET. Steps 148, 150 and 152 all proceed to step 154 to determine if the whole table has been processed. If not, step 154 proceeds to step 156 which increments FLOOR, and step 156 returns to step 144. When the enable table FET has been completely initialized according to car position, step 154 proceeds to step 158.

Steps 158 through 168 form a loop which continuously updates enable table FET according to the positions of the floor cut-out or enable switches 68 shown in FIG. 1. Step 158 initializes the input to check the enable switch associated with the bottom floor. Step 160 checks the position of the switch. If the switch is in the floor enable position, step 162 sets the up and down bits for this floor in enable table FET. If the switch is in the cut out or disable position, step 164 clears the up and down bits for this floor. Steps 162 and 164 proceed to step 166 to determine if the complete table has been processed. If it has not been completely processed, step 168 increments the enable switch input and the program returns to step 160. If the table has been completely processed, the program returns to step 158 to start a new update for the complete table. This loop continues until interrupted by the start of a new run by car 22, or by the car entering the slowdown phase of a run to land at a target floor.

The start of a run may be signaled, for example, by the car controller 38 providing a true acceleration signal ACC, and the slowdown phase may be signalled by the car controller 38 providing a true deceleration signal DEC. Thus when either of these signals goes true, the microcomputer is vectored to location 170, and step 172 checks to see if DEC triggering the interrupt. If DEC is not true, step 174 checks to see if ACC triggered the interrupt. If ACC is not true, the program returns to the interrupted program at 180. If ACC is true, signaling the start of a run, step 176 clears the hall lantern bit in the hall lantern enable table HLE for the floor at which the car is located, and for the travel direction indicated by signal UPTR. This will result in the hall lantern being turned off, as will be hereinafter explained. Step 178 then sets the enable bit for this floor and travel direction in the enable table FET, to enable the associated hall call pushbutton. Step 178 then returns to the interrupted program at 180.

If step 172 finds DEC is true, the car is starting its slowdown phase of a run and step 182 sets the hall lantern bit for the AVP floor and travel direction in enable table HLE, which will result in turning on the associated hall lantern. Step 184 clears the enable for the AVP floor and travel direction in enable table FET, which will result in the resetting of a hall call in the button status table BST which would be served by this stop, and the turning off of the lamp associated with the up or down pushbutton at the target floor. Step 184 then returns to the interrupted program at 180.

Figure 6:
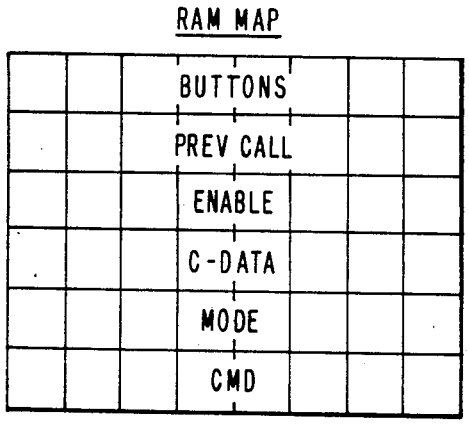
FIG. 6 is a RAM map setting forth program variables utilized by the program shown in FIG. 5.
Figure 5:
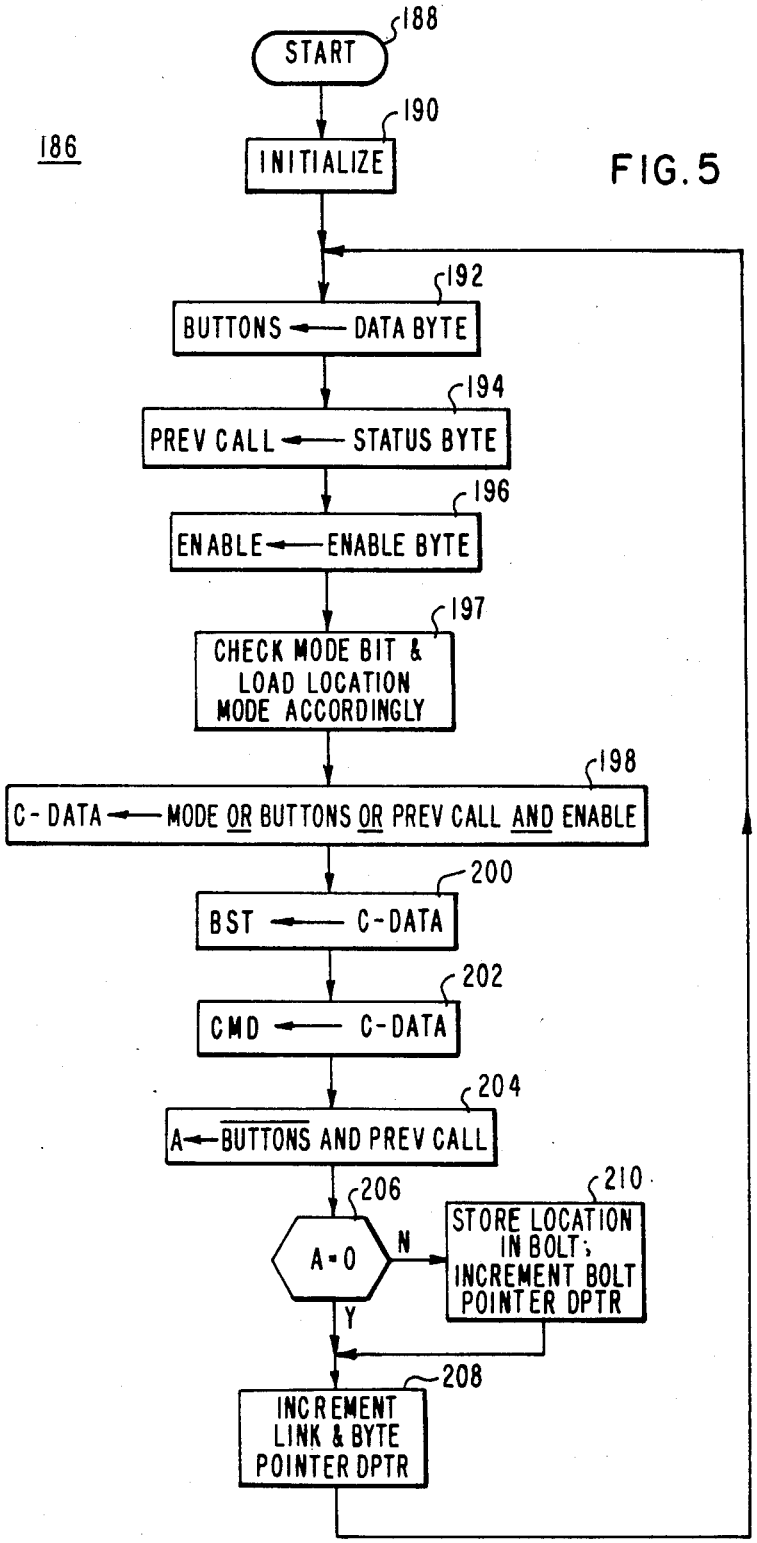
FIG. 5 is a flow chart of a program which provides the logic for checking the integrity of the associated lamp communication system, as well as for detecting lamp failure and providing a record thereof, for elevator maintenance purposes.

FIG. 5 is a flow chart of a program 186 used by controller 56 to provide logic formulated according to the teachings of the invention for detecting and storing indications of burned-out lamps. Program 186 may be run by a second microcomputer in controller 56. Program 186 is entered at 188 and step 190 initializes various program variables, as well as a link and byte pointer DTPR. FIG. 6 is a RAM map setting forth a suitable format for storing various program variables.

Step 192 then reads the first byte associated with link O to obtain data DTA directly from communication line 62. Thus, step 192 reads eight bits from data link O (line 62), synchronized by pulses 0–7 of the clock cycle 0–63. This byte, which includes information from the up pushbuttons from floors 1–8, is stored at a temporary location in RAM referred to as BUTTONS, as shown in FIG. 6.

Step 194 then reads the first data byte of link 0, as indicated by the upper arrow of the link and byte pointer DPTR shown in FIG. 4, and it stores this byte in RAM at a temporary location PREV CALL, as shown in FIG. 6. Step 196 obtains the byte at the position of the lower arrow of pointer DPTR, which byte is from the enable portion of the link, and it stored it at a temporary location ENABLE shown in FIG. 6. Step 197 checks the mode bit and loads a temporary location MODE with zeros if the mode bit is zero, and with ones if the mode bit is a one. The byte MODE enables hall lantern enables to be translated directly to hall lantern turn-on commands when a hall lantern link is being processed.

Step 198 logically combines MODE, BUTTONS, PREV CALL and ENABLE by OR'ing MODE, BUTTONS and PREV CALL, and by AND'ing the result with ENABLE. This result is stored at a temporary location C-DATA shown in FIG. 6. Step 198 thus updates the current status of hall calls (or hall lanterns) from the byte being processed. Step 200 stores C-DATA at the byte location of the upper arrow of pointer DPTR shown in FIG. 4. Since C-DATA reflects either previously existing hall calls, new hall calls, and hall call resets, (or hall lantern requests) step 202 stores C-DATA in the lamp command data storage CMD shown in FIG. 6. The data stored in location CMD of FIG. 6 is synchronously readout to the lamp driver circuits shown in FIG. 1.

Step 204 then performs a logic step by AND'ing $\overline{\text{BUTTONS}}$ (the complement of BUTTONS) and PREV CALL. The result of this comparison is stored at temporary location A, such as in the accumulator. A is tested in step 206 to see if the byte A contains all logic zeros. The comparison performed in step 204 determines if there are any active registered hall calls, i.e., calls for which lamp turn-on requests have been issued in signal CMD, or active hall lantern turn-on requests, which do not have an associated signal which indicates that actual lamp energization has been detected. If the test result of step 206 finds A is zero, it indicates that every lamp which should be energized is actually energized, and step 206 advances to step 208 which increments the link and byte pointer DPTR. When one link is finished the pointer goes to the next link. The program then returns to step 192 to process the next byte of the link. If step 206 finds byte A is not equal to zero it indicates lamp burn-out, and step 210 stores the link and bit number at the position of pointer PTR in table BOLT shown in FIG. 3. Step 210 then proceeds to step 208 which increments pointer DPTR.

Figure 7:
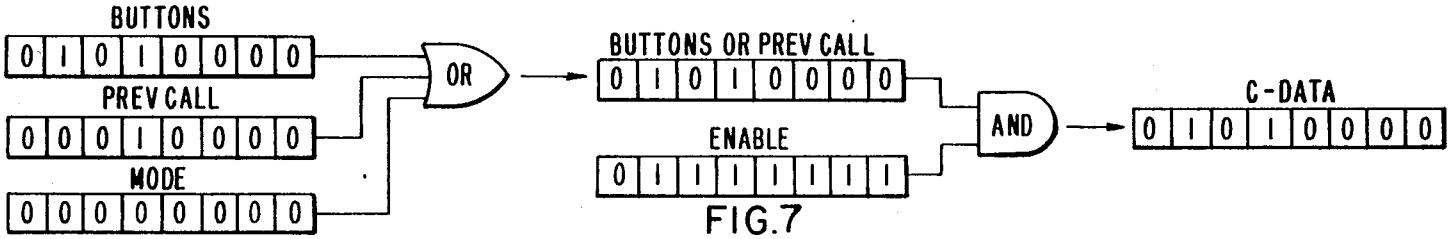
FIGS. 7 through 14 diagrammatically illustrate examples of the logic performed by the program shown in FIG. 5.
Figure 8:
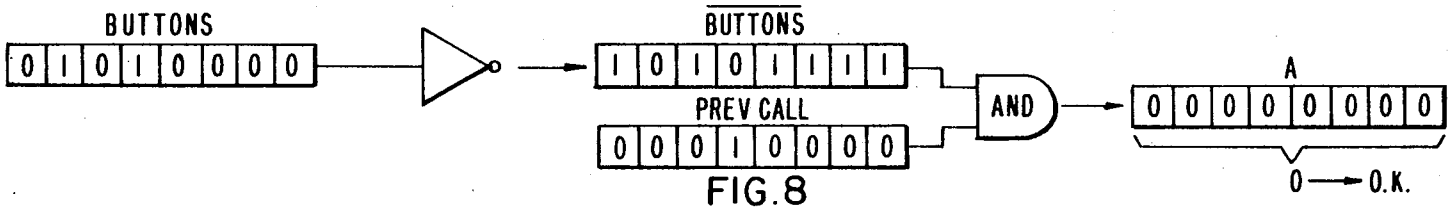

FIGS. 7 and 8 set forth an example of logic steps 198 and 204, respectively, of the program 186 shown in FIG. 5. In this example, as hall call pushbutton link is being processed, and there are no burned-out lamps. As shown in PREV CALL there was a previously recognized up call from the fifth floor which is still active. BUTTONS indicates up calls from the fifth and seventh floor, so the up call from the seventh floor is a new hall call. OR'ing MODE, BUTTONS and PREV CALL produces a byte which indicates up hall calls at the fifth and seventh floors. AND'ing this request with ENABLE, which has floors 1 through 7 enabled, produces the byte C-DATA having up calls at the fifth and seventh floors. Complementing BUTTONS and AND'ing $\overline{\text{BUTTONS}}$ with PREV CALL, in FIG. 8, produces a byte A having all zeros, indicating no burned-out lamps.

Figure 9:
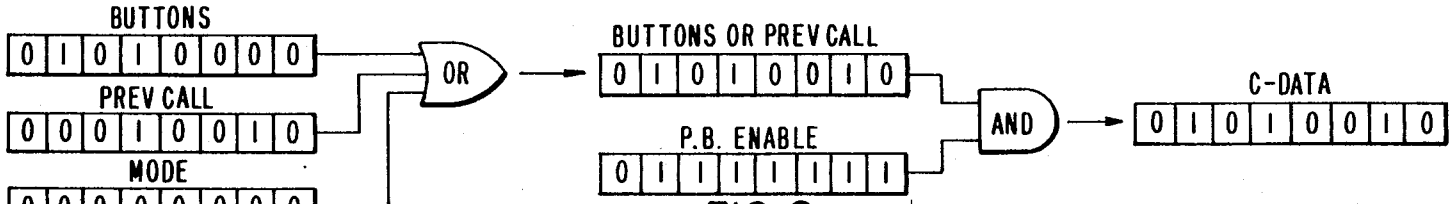
Figure 10:
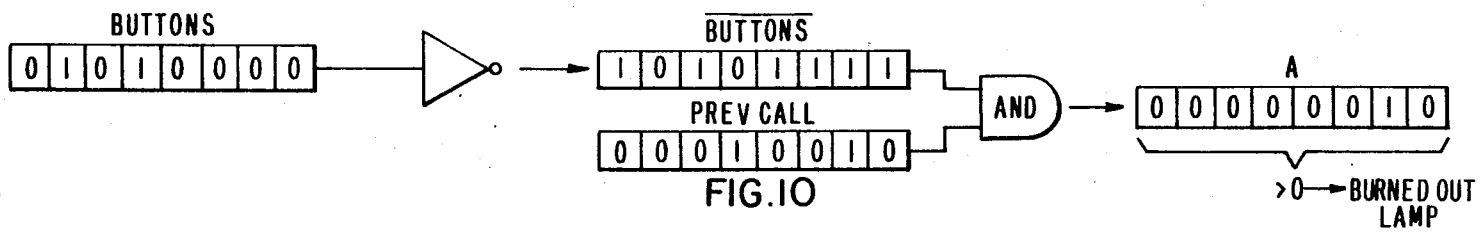

FIGS. 9 and 10 set forth a similar example of logic steps 198 and 204, respectively, except with a burned-out up bushbutton lamp at the second floor. For example, previously recognized active up calls exist at the second and fifth floors, as shown in the byte PREV CALL. BUTTONS indicates up calls from floors 5 and 7. C-DATA shows up calls from floors 2, 5 and 7. OR'ing $\overline{\text{BUTTONS}}$ with PREV CALL picks up the burned-out up hall call lamp at the second floor.

FIGS. 11–14 are similar to FIGS. 7 through 10, except they illustrate logic steps 198 and 204 for a hall lantern link. In this instance MODE is all logic ones. Thus, in effect, the appropriate hall lantern enable byte from FIG. 4 becomes C-DATA which is used as the lamp turn-on command byte CMD. In this example, the car is in the process of stopping for an up hall call at the fifth floor. When the up call hall lamp at the fifth floor is turned off, lamp command CMD will turn on the up hall lantern at the fifth floor. Thus, if the lamps are not burned out, the bit in BUTTONS representing the up direction from the fifth floor will remain set. Thus, when $\overline{\text{BUTTONS}}$ and PREV CALL are compared in FIG. 12, the result A will be zero, indicating no failed lamps.

Figures 11, 12, 13, 14:
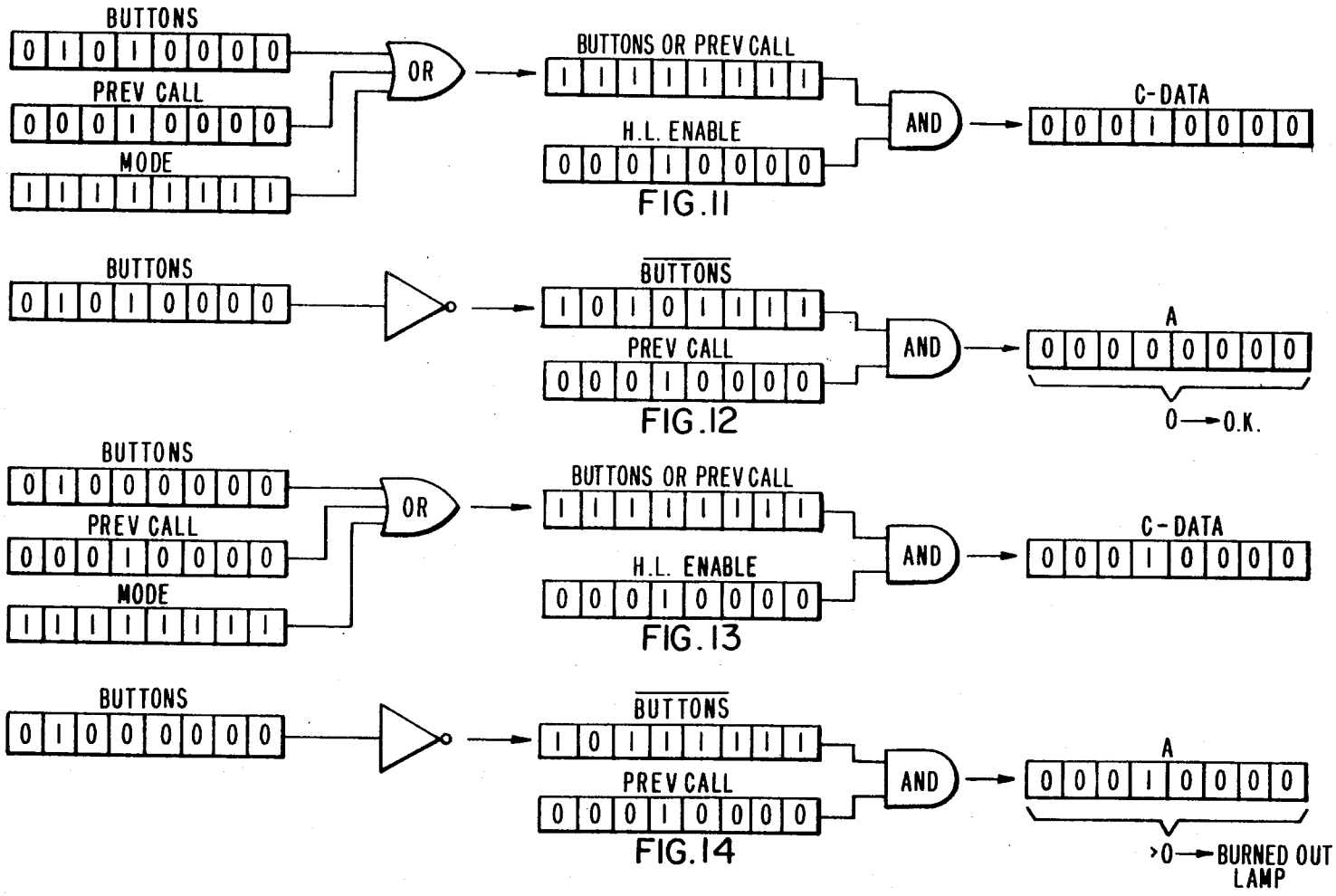

If the up hall lantern at the fifth floor is burned out, FIG. 13 will still result in the same C-DATA byte, but BUTTONS will have a zero at the bit location for the fifth floor. AND'ing $\overline{\text{BUTTONS}}$ and PREV CALL thus results in A being non-zero, with bit position 4 having the logic one. The pulse number of this bit location coupled with the link number, is stored to identify the up hall lantern at the fifth floor as being faulty.

Testing of the hall call lamps and hall lanterns occurs automatically during the normal operation of the elevator system 20. The integrity of the hall call and hall lantern circuits may also be tested by service personnel without actually operating the cars. For example, the service person may set all of the bits in each byte of CMD for all links, or selectively set desired bits. If the hall call and hall lantern system is operative, the selected lamps will be energized and signal DTA will indicate return signals from these lamps. If all lamps are requested to turn on, and DTA is all logic zeros, the all call or hall lantern system has malfunctioned. If DTA contains logic zero signals where there should be logic one signals, the zeros indicate a fault in the associated lamp and/or lamp driver circuit.

While the invention has been described relative to the hall call and hall lantern functions, it may be applied with equal effectiveness to other functions having a plurality of distributed lamps.

In summary, there has been disclosed new and improved apparatus and methods for determining which lamp, of a plurality of lamps, has burned out in any elevator function having a plurality of lamps controlled by a common lamp controller. The apparatus requires only one microcomputer based lamp controller, making it unnecessary to have a microcomputer associated with each floor. It is only necessary to add a low cost optocoupler IC package, or similar energization detector, for each lamp, and a logic program for the microcomputer of the single lamp controller. The new and improved methods utilize the same communication lines and the same communication time slots that the lamp control system would require without the testing functions added by the present invention.

We claim as our invention:

1. A method of controlling the energization of a lamp in an elevator system, and detecting failure thereof, via a microcomputer based lamp controller and a minimum number of communication lines, comprising the steps of:

detecting a signal which indicates a predetermined lamp should be energized, requesting energization of the predetermined lamp via a predetermined communication line when said signal is detected, storing an indication that energization of the lamp has been requested, detecting actual energization of the lamp, placing a signal on a second communication line when said detecting step detects actual energization of the lamp, monitoring said second communication line, and indicating that the lamp is burned out when the monitoring step fails to detect a signal on said second communication line after the storing step has stored an indication that lamp energization has been requested.

2. The method of claim 1 wherein the indicating step includes the step of storing the indication in memory for later retrieval.

3. The method of claim 1 including the step of placing the signal which indicates a predetermined lamp should be energized on the second communication line, with the monitoring step detecting the signal.

4. A method of selectively controlling the energization of a plurality of lamps in an elevator system, and detecting failures thereof, via a microcomputer based lamp controller and a minimum number of communication lines, comprising the steps of:

enabling the lamps in a predetermined sequence via a first communication line, detecting a signal which indicates a predetermined lamp should be energized, monitoring a second communication line, requesting the energization of an enabled lamp via a third communication line, which lamp is associated with a signal detected by said detecting step, storing an indication that energization of the associated lamp has been requested, detecting actual energization of the associated lamp, placing a signal on the second communication line when said detecting step detects actual energization of the associated lamp, and the associated lamp is enabled by the first communication line, and indicating that the associated lamp is burned out when the monitoring step fails to detect a signal on the second communication line related to the associated lamp, after the storing step has stored an indication that energization of the associated lamp has been requested.

5. The method of claim 4 wherein the indicating step includes the step of storing the indication in memory for later retrieval.

6. The method of claim 4 wherein the indicating step includes the step of comparing the stored indications of lamp energization request with signals detected by the monitoring step, with said comparing step being synchronized by the enabling step.

7. The method of claim 4 including the step of placing the signal which indicates a predetermined lamp should be energized or the second communication line, with the monitoring step detecting the signal.

8. A method of controlling a plurality of hall call registered lamps associated with hall call pushbuttons in an elevator system via a microcomputer based lamp controller, with said method including an automatic mode in which lamp control and lamp failure detection occurs during normal operation of the elevator system, comprising the steps of:

enabling the lamps in a predetermined sequence via signals placed on a first communication line, to synchronize signals associated with the lamps which are placed on second and third communication lines, placing a signal on the second communication line in response to pushbutton actuation, monitoring the second communication line, placing a signal on the third communication line when the monitoring step detects a signal, to request energization of a lamp associated with the pushbutton which initiated the signal on the second communication line, storing an indication that energization of the associated lamp has been requested, detecting actual energization of the associated lamp, placing a signal on the second communication line in response to said detecting step, and indicating that the associated lamp is burned out when the monitoring step fails to detect a signal on the second communication line related to the associated lamp, after the storing step has stored an indication that energization of the associated lamp has been requested.

9. The method of claim 8 which includes a test mode comprising the steps of:

enabling the lamps in a predetermined sequence via signals placed on the first communication line to synchronize signals associated with the lamps which are placed on the second and third communication lines, placing a signal on the third communication line to request energization of a predetermined lamp, storing an indication that energization of the predetermined lamp has been requested, detecting actual energization of the predetermined lamp, placing a signal on the second communication line in response to said detecting step, monitoring the second communication line, and indicating a fault when the monitoring step fails to detect a signal associated with the predetermined lamp on the second communication line.

10. The method of claim 8 wherein a plurality of hall lanterns are also controlled by the same microcomputer based lamp controller, and including the steps of:

detecting a signal which indicates a predetermined hall lantern should be energized, enabling the hall lanterns in a predetermined sequence via signals placed on a predetermined communication line, to synchronize signals associated with the hall lanterns which are placed on other communication lines, placing a signal on a predetermined communication line when said detecting step detects a signal indicating a hall lantern should be energized, storing an indication that energization of the associated hall lantern has been requested, detecting actual energization of the associated hall lantern, placing a signal on a predetermined communication line in response to said detecting step, and indicating that the associated hall lantern is burned out when the monitoring step fails to detect a signal on a communication line responsive to said detecting and placing steps which is related to the associated hall lantern, after the storing step has stored an indication that energization of the associated hall lantern has been requested.

11. Apparatus for selectively controlling the energization of a plurality of lamps in an elevator system, and for detecting failures of the lamps, via a minimum number of communication lines, comprising:

a plurality of lamps, lamp driver means for each of said plurality of lamps, supervisory lamp control means for controlling said plurality of lamp driver means, and first, second and third communication lines linking said supervisory lamp control means with each of said lamp driver means, said supervisory lamp control means sequentially enabling said plurality of lamp driver means via said first communication line, to synchronize the placing of signals on said second and third communication lines, said supervisory lamp control means including monitoring means for detecting signals on the second communication line, means for placing a signal on the third communication line requesting the energization of a lamp, and means for storing an indication that energization of the associated lamp has been requested, each of said lamp driver means including means for detecting actual energization of the associated lamp, and means for placing a signal on the second communication line when the detecting means detects actual energization of the associated lamp, said supervisory lamp control means further including comparator means for comparing stored lamp energization requests with signals detected by said monitoring means, and storage means responsive to said comparator means for storing an indication of lamp burn-out for each lamp associated with a stored energization request which is not matched with a signal of the second communication line.

12. An elevator system, comprising:

a building having a plurality of floors, an elevator car mounted in said building to serve the floors, hall call and hall lantern control means including a supervisory lamp controller, hall stations at each of said plurality of floors, and a communication link comprising a plurality of communication lines disposed between said hall call and hall lantern control means and each of said hall stations, a first communication line controlling the synchronization of signals placed on the other communication lines, certain of said hall stations being hall call stations which includes at least one pushbutton which places a signal on a communication line when actuated, a lamp associated with each pushbutton, lamp driver means for receiving lamp commands over a communication line, and enable means responsive to the first communication line, the remaining hall stations being hall lantern stations which include a lamp, lamp driver means for receiving lamp commands over a communication line, and enable means responsive to the first communication line, and hall lantern enable means for indicating when a hall lantern should be energized, said supervisory lamp controller including monitoring means for monitoring said hall lantern enable means and a predetermined communication line, means for placing a signal on a communication line in response to said monitoring means which requests energization of a predetermined lamp, and storage means for storing an indication that energization of the associated lamp has been requested, each of said hall stations including means responsive to actual energization of a lamp for placing a signal of a monitored communication line, said supervisory controller further including comparator means for comparing stored lamp energization requests with signals detected on the monitored communication line, and means responsive to said comparator means for storing an indication of lamp burn-out for each lamp associated with a stored energization request which is not matched with an associated signal on monitored communication line.

13. The elevator system of claim 12 wherein the means responsive to actual energization of a lamp develops a continuous signal coextensive with lamp energization which is synchronously placed on the second communication line.

14. The elevator system of claim 12 including a car controller for controlling said elevator car, and memory means shared by said car controller and the hall call and hall lantern control means, with the storage means for storing indications of lamp energization requests being part of said shared memory and functioning as a call table in which calls are set and reset by the hall call and hall lantern control means.

15. The elevator system of claim 12 wherein the means responsive to actual energization of a lamp is connected to simulate pushbutton actuation in the hall call stations.

16. The elevator system of claim 12 wherein the means responsive to actual energization of a lamp includes an opto-coupler.

* * * * *